US005203064A

United States Patent [19]

Johnson

[11] Patent Number: 5,203,064

[45] Date of Patent: Apr. 20, 1993

[54] VALVE STEM ALIGNMENT TOOL

[76] Inventor: Gary L. Johnson, 509 Washington Ave. N. #29, Kent, Wash. 98032

[21] Appl. No.: 867,500

[22] Filed: Apr. 13, 1992

[51] Int. Cl.[5] ..... B25B 27/14

[52] U.S. Cl. ..... 29/271

[58] Field of Search ..... 72/705; 254/30, 100; 248/499, 500, 503; 269/46; 29/271, 256

[56] References Cited

U.S. PATENT DOCUMENTS

| | | | |
|---|---|---|---|
| 1,668,977 | 5/1928 | Renari | 254/100 |
| 2,725,917 | 12/1955 | Kauppi | 72/705 |
| 3,011,818 | 12/1961 | Matthiessen | 248/499 |
| 3,149,659 | 9/1964 | Bogert | 72/705 |
| 3,229,952 | 1/1966 | Zumbo | 248/499 |
| 3,991,976 | 11/1976 | Skinner | 254/30 |
| 4,589,179 | 5/1986 | Hulting | 29/271 |
| 4,941,765 | 7/1990 | Horan et al. | 72/705 |

*Primary Examiner*—Robert C. Watson
*Attorney, Agent, or Firm*—Leon Gilden

[57] ABSTRACT

A tool used particularly with vehicular tires, including inflatable inner tubes, is formed with a rim clamp arranged for securement to a peripheral rim portion of a vehicular tire rim, and an internallyy threaded or alternatively smooth bore cap member arranged for securement to a valve stem, with a plurality of chain links of adjustable length mounted between the rim clamp and the cap member to maintain alignment of the valve stem during installation and removal of a valve stem or valve stem and tube member relative to the vehicular rim.

3 Claims, 4 Drawing Sheets

VALVE STEM ALIGNMENT TOOL

BACKGROUND OF THE INVENTION

1. Field of the Invention

The field of invention relates to vehicular tire apparatus, and more particularly pertains to a new and improved valve stem alignment tool wherein the same is directed to the alignment of a valve stem during dismounting of tires and associated inner tubes relative to a vehicular rim, particularly for use with truck tires of increased size.

2. Description of the Prior Art

The dismounting of inner tubes relative to a truck tire rim permits the additional hazard of damage to the valve stem during its projection and during insertion and removal of the valve stem relative to a vehicular tire rim. To overcome disadvantages of the prior art, the instant invention is addressed to the alignment of the valve stem relative to a through-extending bore of the tire rim to minimize damage to the valve stem. Prior art vehicular tire structure available is set forth in the U.S. Pat. No. 4,807,343 to Wadsworth setting forth a valve stem inserter for utilization with tubeless tires.

Similarly, U.S. Pat. No. 4,750,258 to Sampo and U.S. Pat. No. 4,765,048 to Hokanson are further examples of tubeless tire valve stem inserters.

U.S. Pat. No. 4,275,622 to Ford sets forth a dual wheel valve stem tool arranged for engaging the valve stem retainer nut on an interior wheel of dual wheels without removal of the outer wheel member recognizing particular difficulties of maintenance of truck tires of dual wheel construction.

As such, it may be appreciated that there continues to be a need for a new and improved valve stem alignment tool as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of valve stem tool apparatus now present in the prior art, the present invention provides a valve stem alignment tool wherein the same is directed to the alignment and orientation of a valve stem relative to a vehicular tire rim. As such, the general purpose of the present invention, which will be described subsequently in greater detail, is to provide a new and improved valve stem alignment tool which has all the advantages of the prior art vehicular tire tool apparatus and none of the disadvantages.

To attain this, the present invention provides a tool used particularly with vehicular tires, including inflatable inner tubes formed with a rim clamp arranged for securement to a peripheral rim portion of a vehicular tire rim, and an internally threaded or smooth bore cap member arranged for securement to a valve stem, with a plurality of chain links of adjustable length mounted between the rim clamp and the cap member to maintain alignment of the valve stem during removal of a valve stem relative to the vehicular rim.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved valve stem alignment tool which has all the advantages of the prior art vehicular tire tool apparatus and none of the disadvantages.

It is another object of the present invention to provide a new and improved valve stem alignment tool which may be easily and efficiently manufactured and marketed.

It is a further object of the present invention to provide a new and improved valve stem alignment tool which is of a durable and reliable construction.

An even further object of the present invention is to provide a new and improved valve stem alignment tool which is susceptible of a low cost of manufacture with regard to both materials and labor, and which accordingly is then susceptible of low prices of sale to the consuming public, thereby making such valve stem alignment tools economically available to the buying public.

Still yet another object of the present invention is to provide a new and improved valve stem alignment tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
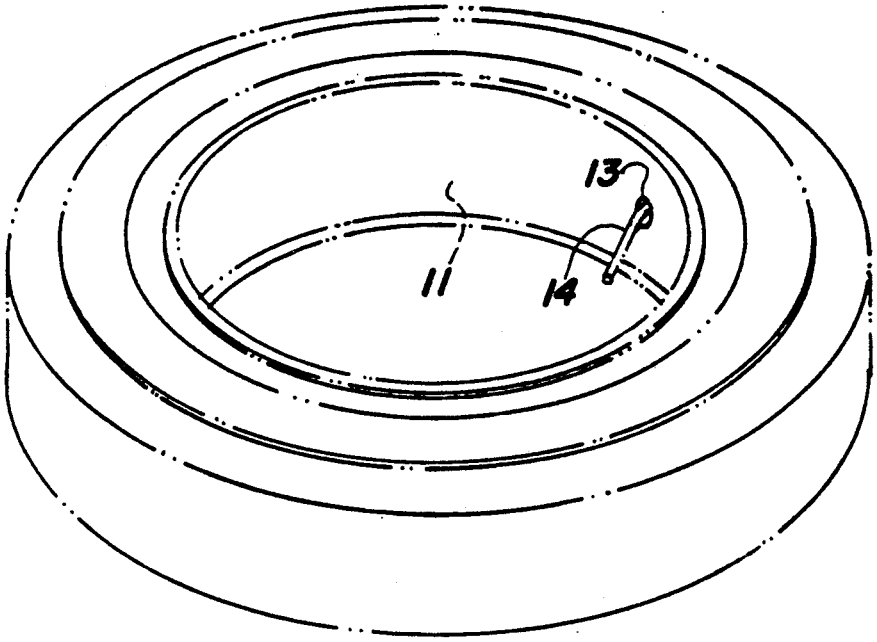
FIG. 1 is an isometric illustration of a conventional vehicular tire and the valve stem projecting therethrough.

With reference now to the drawings, and in particular to FIGS. 1 to 11 thereof, a new and improved valve stem alignment tool embodying the principles and concepts of the present invention and generally designated by the reference numeral 10 will be described.

Figure 2:
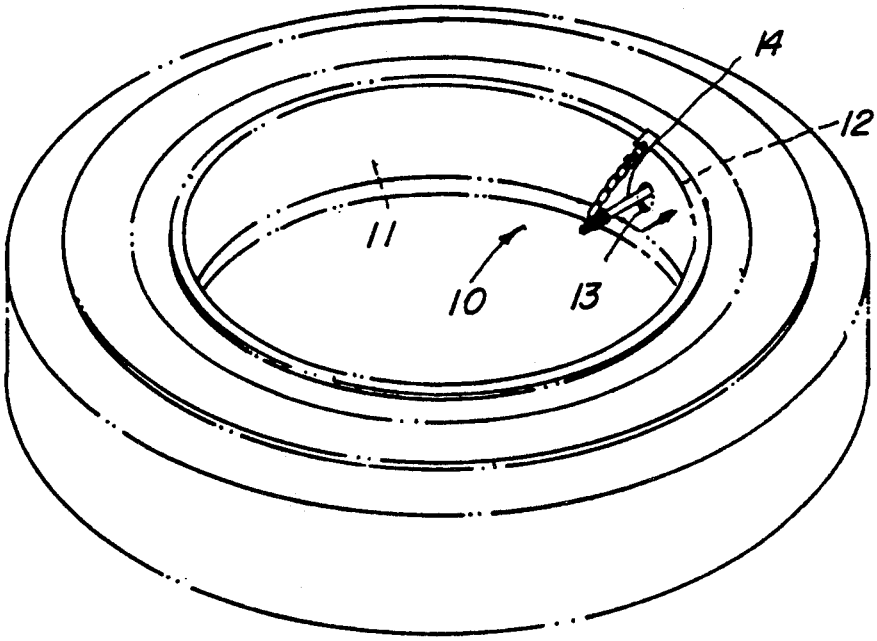
FIG. 2 is an isometric illustration of the tool member mounted to the valve stem to maintain alignment of the valve stem relative to the valve stem receiving bore of the tire rim.
Figure 3:
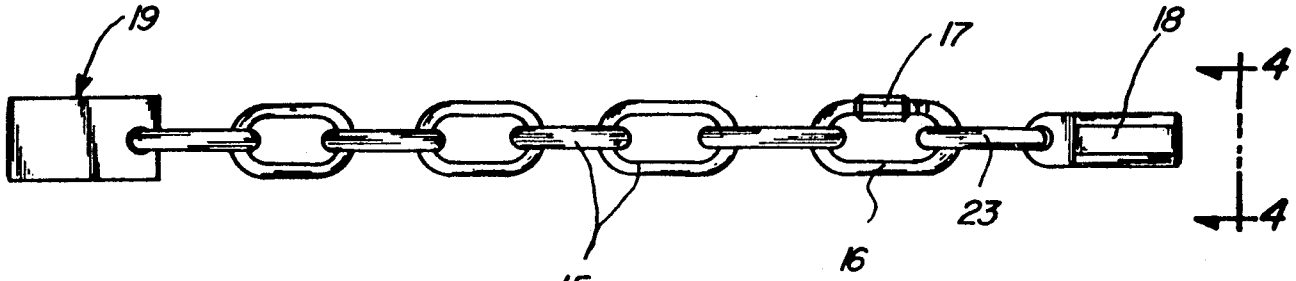
FIG. 3 is an orthographic view of the invention.
Figure 4:
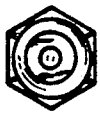
FIG. 4 is an orthographic view, taken along the lines 4—4 of FIG. 3 in the direction indicated by the arrows.
Figure 5:
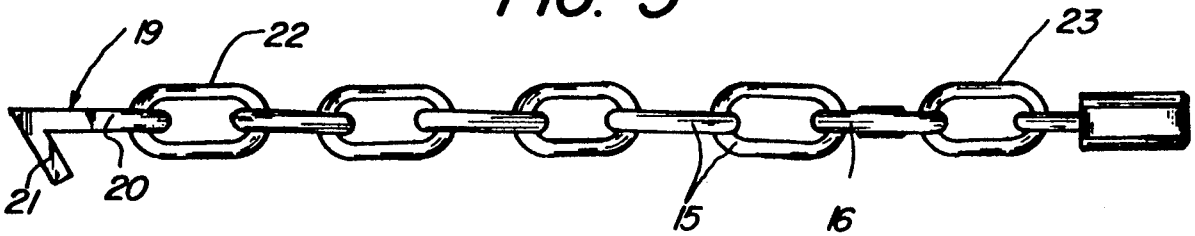
FIG. 5 is an orthographic view of the invention illustrating the rim clamp in an engaging orientation.

More specifically, the valve stem alignment tool 10 is arranged for cooperation with a vehicular tire, of a type such as illustrated in the FIGS. 1 and 2, having a vehicular tire rim 11 formed with a peripheral annular flange 12 having a tire thereon. A tire rim valve stem receiving bore 13 is directed through the rim 11 receiving a valve stem 14 therethrough formed with an externally threaded free end, with the valve stem 14 in pneumatic communication with an inner tube positioned within the tire of conventional construction. The apparatus includes a plurality of chain links 15, including a removable chain link 16 permitting adjustment of effective length of the chain links when tensioned, in a manner as illustrated in FIG. 2. The removal chain links 16 includes a separable connection 17 permitting removal of the links 16. A cap member 18 formed with an internally threaded or alternatively a smooth valve stem receiving bore 18 is mounted to a cap member chain link 23 positioned adjacent the cap member 18, with a rim clamp 19 mounted at an opposed distal end of the chain links to a clamp chain link 22 in a pivotal relationship. The rim clamp 19 includes a first plate 20 integrally mounted to a second plate 21 defining an acute angle therebetween for receiving the tire rim peripheral annular flange 12, in a manner as illustrated in FIG. 2.

In this manner, insertion or removal of the valve stem 14 is effected permitting substantial coaxial alignment of the valve stem relative to the valve stem receiving bore 13 upon appropriate tensioning of the chain links 15 to include the clamp and cap member chain links 22 and 23 respectively.

Figure 6:
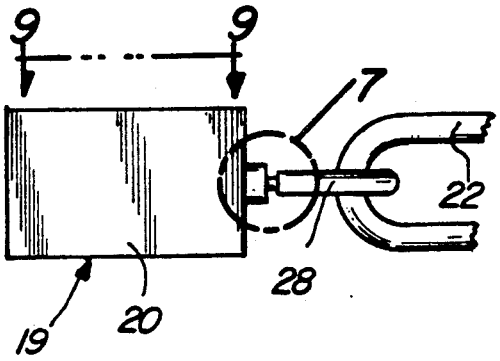
FIG. 6 is an orthographic view of a modified linkage interconnection between the chain links and the rim clamp.
Figure 7:
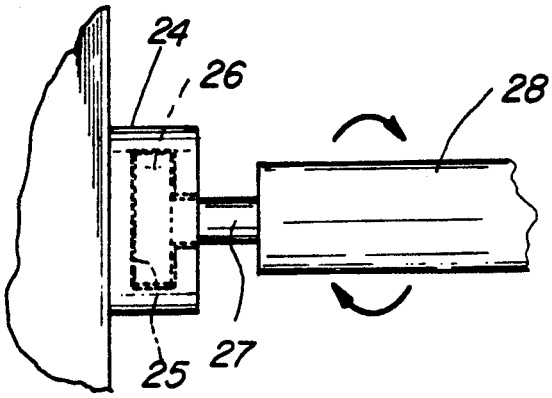
FIG. 7 is an enlarged orthographic view of section 7, as set forth in FIG. 6.
Figure 8:
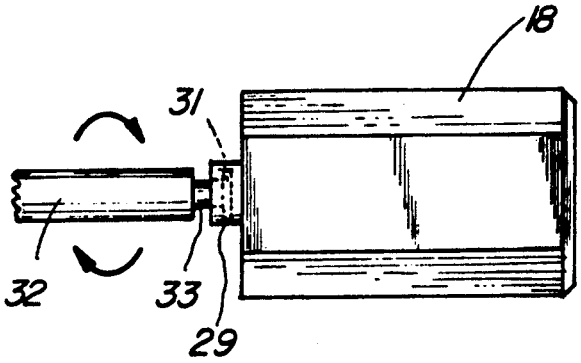
FIG. 8 is an orthographic view of rotative intercommunication between the cap member and the chain links.

The FIGS. 6 and 7 illustrate the clamp chain link 22 formed with a first swivel yoke 24 mounted to a rear distal end of the first plate 20, with the first swivel yoke 24 including a first yoke cylindrical socket 25 rotatably receiving a first cylindrical plate 26 that has integrally and coaxially mounted thereto a first connector rod 27 extending rearwardly to a first link plate 28 that in turn is mounted to the clamp chain link 22.

Figure 9:
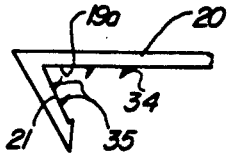
FIG. 9 is an orthographic view, taken along the lines 9—9 of FIG. 7 in the direction indicated by the arrows, indicating the use of engaging teeth members of the rim clamp.

A second swivel yoke 29 (see FIG. 8) is mounted to a rear distal end of the cap member 18, with the second swivel yoke 29 including a second cylindrical socket to rotatably receive a second cylindrical plate 31 formed to a forward distal end in a coaxially aligned relationship of a second connector rod 33 that in turn is mounted to a second link plate 32 that is then mounted to the cap member chain link 23. In this manner, a nonbinding relationship of the rim clamp 19 and the cap member 18 is afforded to the organization. The FIG. 9 illustrates the first and second plates 20 and 21, including respective first and second plate teeth 34 and 35 canted towards the intersection 19*a* of the first and second plates 20 and 21 to enhance engagement relative to the annular flange 12.

Figure 10:
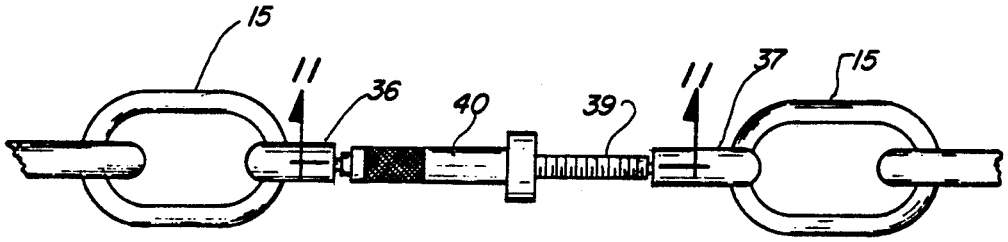
FIG. 10 is an orthographic view of a modified adjuster member utilized by the invention.
Figure 11:
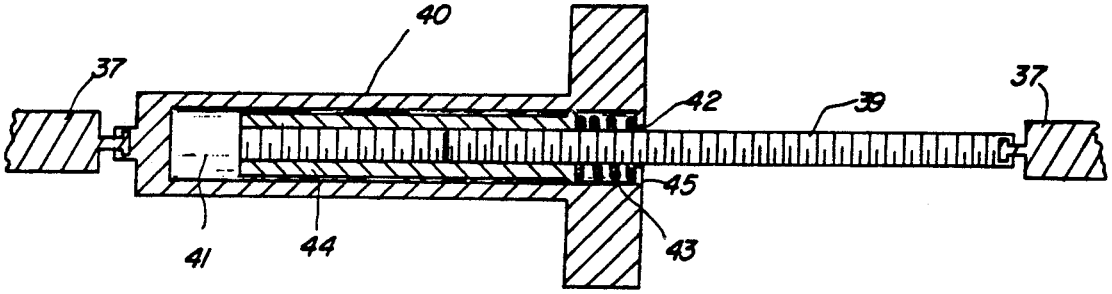
FIG. 11 is an orthographic view, taken along the lines 11—11 of FIG. 10 in the direction indicated by the arrows.

The FIGS. 10 and 11 illustrate an adjuster member utilized in lieu of the removable chain link 16. The adjuster member includes a first link swivel yoke 36 mounted to a chain link 15, with a second link swivel yoke 37 mounted to a further chain link 15 at a spaced relationship relative to one another. An externally threaded adjuster rod 39 is at its rear distal end rotatably mounted to the second link swivel yoke 37 and having its forward extend threadedly received within an internally threaded sleeve 44. A receiver housing 40, including a housing cylindrical cavity 41, and a cavity entrance 42, receives the rod 39 therethrough, with a spring member 43 interposed between the internally threaded sleeve 44 and an entrance flange 45 at the cylindrical cavity entrance 42 to maintain spring biased tensioning of the spaced chain links 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A valve stem alignment tool arranged for mounting to a vehicular tire rim having a peripheral annular flange, with the vehicular tire rim including a valve stem receiving bore directed therethrough spaced from the peripheral annular flange, and a valve stem slidably directed through the valve stem receiving bore, wherein the tool comprises, a plurality of chain links, and the chain links including adjustment means mounted between adjacent chain links of said chain links for adjusting effective length of said chain links, and said chain links including a clamp chain link mounted at a first distal end of said chain links, and a cap member chain link mounted at a second distal end of said chain links, and said clamp chain link mounted to a "V" shaped rim clamp and said cap member chain link mounted to a cap member, with the cap member including a valve stem receiving bore for receiving a free distal end of said stem therewithin, and the rim clamp includes a first plate fixedly mounted to a second plate at an intersection defining an acute angle between the first plate and the second plate, and the first plate includes a matrix of first plate teeth canted towards the intersection, and the second plate includes a matrix of second teeth canted towards the intersection, and the first plate includes a first plate rear distal end, the first plate rear distal end including a first swivel yoke, the first swivel yoke including a first yoke cylindrical socket and a first cylindrical plate rotatably mounted within the first cylindrical socket captured therewithin, and a first connector rod fixedly and coaxially mounted to the first cylindrical plate extending exteriorly of the first swivel yoke, the first connector rod fixedly mounted to a first link plate, said first link plate mounted to one of said chain links at said first distal end.

2. A tool as set forth in claim 1 wherein the cap member includes a cap member rear distal end, the cap member rear distal end including a second swivel yoke, the second swivel yoke having a second cylindrical socket, the second cylindrical socket including a second cylindrical plate rotatably mounted and captured therewithin, and a second cylindrical plate including a second connector rod fixedly and coaxially mounted to the second cylindrical plate, the second connector rod mounted to one of said chain links at said second distal end of said chain links.

3. A tool as set forth in claim 2 wherein said adjustment means is positioned between adjacent chain links of said chain links, wherein said adjustment means includes a first link swivel yoke mounted to one of said chain links and a second link swivel yoke mounted to an adjacent and spaced chain link of said chain links, wherein said first link swivel yoke includes a receiver housing rotatably mounted thereto, and said second link swivel yoke includes an externally threaded rod rotatably mounted thereto, said receiver housing including a cylindrical cavity, with the cylindrical cavity coaxially aligned with the adjuster rod, the cylindrical cavity including a cylindrical cavity entrance, and the cylindrical cavity entrance including an entrance flange, and the cylindrical cavity including an internally threaded sleeve slidably mounted within the cylindrical cavity, and the internally threaded sleeve including an internally threaded sleeve bore threadedly receiving the adjuster rod, and a spring member interposed between the sleeve and the entrance flange.

* * * * *